US010415859B2

(12) United States Patent
Du

(10) Patent No.: US 10,415,859 B2
(45) Date of Patent: Sep. 17, 2019

(54) HEAT RECOVERY SYSTEM WITH LIQUID SEPARATOR APPLICATION

(71) Applicants: TRANE INTERNATIONAL INC., Davidson, NC (US); TRANE AIR CONDITIONING SYSTEMS (CHINA) CO., LTD., Taicang, Jiangsu (CN)

(72) Inventor: Yu Qing Du, Jiangsu Province (CN)

(73) Assignees: TRANE INTERNATIONAL INC., Davidson, NC (US); TRANE AIR CONDITIONING SYSTEMS (CHINA) CO., LTD., Taicang, Jiangsu Province (CN)

( * ) Notice: Subject to any disclaimer, the term of this patent is extended or adjusted under 35 U.S.C. 154(b) by 0 days.

(21) Appl. No.: 15/740,501

(22) PCT Filed: Jul. 1, 2015

(86) PCT No.: PCT/CN2015/083065
§ 371 (c)(1),
(2) Date: Dec. 28, 2017

(87) PCT Pub. No.: WO2017/000279
PCT Pub. Date: Jan. 5, 2017

(65) Prior Publication Data
US 2018/0313587 A1 Nov. 1, 2018

(51) Int. Cl.
*F25B 40/02* (2006.01)
*F25B 43/00* (2006.01)
*F25B 6/04* (2006.01)

(52) U.S. Cl.
CPC ..... *F25B 40/02* (2013.01); *F25B 6/04* (2013.01); *F25B 43/006* (2013.01);
(Continued)

(58) Field of Classification Search
CPC ..... F25B 40/02; F25B 6/04; F25B 43/006; F25B 2339/047; F25B 2400/16;
(Continued)

(56) References Cited

U.S. PATENT DOCUMENTS 3,177,674 A * 4/1965 Spofford ..... F25B 1/00 62/129
3,183,896 A * 5/1965 Lytle ..... F22B 35/14 122/406.5
(Continued)

FOREIGN PATENT DOCUMENTS

CN 201527134 U 7/2010
CN 103225935 A 7/2013
(Continued)

OTHER PUBLICATIONS

Extended European Search Report; European Patent Application No. 15896810.7, dated Nov. 30, 2018 (9 pages).
(Continued)

*Primary Examiner* — Melvin Jones
(74) *Attorney, Agent, or Firm* — Hamre, Schumann, Mueller & Larson, P.C.

(57) ABSTRACT

A heat recovery system and methods of their use that include a liquid separator, which allows for relatively less refrigerant charge needed for operation of the heat recovery system, e.g. in a cooling and/or heat recovery mode. The liquid separator separates the liquid and vapor from fluid exiting the heat recovery exchanger, which can ensure that the inlet of the condenser coil is sourced with vapor and minimizes liquid entering the condenser coil. The liquid separator does not receive liquid refrigerant from the condenser coil, such as in a regular operating mode (e.g. cooling and/or heat recovery mode). Use of the liquid separator and its arrangement within the fluid circuit can thereby reduce the operating refrigerant charge needed for the system. A flow control
(Continued)

device can control the heat recovery and/or cooling capacity of the heat recovery system.

13 Claims, 3 Drawing Sheets

(52) U.S. Cl.
CPC ..... *F25B 2339/047* (2013.01); *F25B 2400/16* (2013.01); *F25B 2400/23* (2013.01)

(58) Field of Classification Search
CPC ..... F25B 2400/23; F25B 49/005; F25B 2339/044; F25B 2500/19; F25B 2500/222
See application file for complete search history.

(56) References Cited

U.S. PATENT DOCUMENTS 4,098,092 A 7/1978 Singh
4,773,231 A 9/1988 Sulzberger
5,088,304 A * 2/1992 Schlichtig ..... F25B 1/047 418/15
5,755,104 A 5/1998 Rafalovich et al.
5,802,864 A 9/1998 Yarbrough et al.
6,041,613 A 3/2000 Morse et al.
6,145,331 A * 11/2000 Tuhro ..... F25B 6/04 101/487
6,615,602 B2 * 9/2003 Wilkinson ..... F24D 5/12 62/238.7
8,074,459 B2 12/2011 Murakami et al.
8,079,229 B2 12/2011 Lifson et al.
8,109,111 B2 * 2/2012 Yamada ..... F25B 13/00 62/324.1
8,220,531 B2 7/2012 Murakami et al.
2010/0012291 A1 1/2010 Sporie
2010/0243202 A1 9/2010 Han et al.
2014/0033743 A1 2/2014 Hancock
2016/0109170 A1 * 4/2016 Schrey ..... F25B 40/02 62/115
2017/0167767 A1 * 6/2017 Shi ..... F25B 1/00

FOREIGN PATENT DOCUMENTS

EP 2378222 A2 10/2011
JP 2002130819 A 5/2002
WO 2013/164036 A1 11/2013
WO 2015/039688 A1 3/2015

OTHER PUBLICATIONS

International Search Report and Written Opinion, International Patent Application No. PCT/CN2015/083065, dated Mar. 24, 2016 (7 pages).

* cited by examiner

HEAT RECOVERY SYSTEM WITH LIQUID SEPARATOR APPLICATION

FIELD

The disclosure herein relates generally to a heat recovery system, such as for example, a refrigerant system that provides cooling and heating. In particular the disclosure herein relates to a heat recovery system that includes a liquid separator, which allows for less refrigerant charge to be needed for operation of the heat recovery system relative to certain serial and parallel flow systems.

BACKGROUND

Heat recovery systems are known, which employ a heat recovery exchanger, for example to heat water for various uses, including residential or commercial use. The refrigerant charge used in heat recovery systems can be relatively high. For example, depending on the amount of capacity used by the heat recovery exchanger, a high amount of liquid refrigerant can be exited from the heat recovery heat exchanger. The condenser may then fill up with the high amount of liquid, where a liquid receiver is in fluid communication with the liquid outlet of the condenser, for example where the liquid receiver is in fluid communication with the condenser intermediate of the condensing portion and the sub-cooler portion. A relatively large receiver is employed to handle the refrigerant charge.

SUMMARY

The disclosure herein relates generally to a heat recovery system, such as for example, a refrigerant system that provides cooling and heating. In particular the disclosure herein relates to a heat recovery system that includes a liquid separator, which allows for less refrigerant charge to be needed for operation of the heat recovery system relative to for example certain serial and parallel flow systems.

Heat recovery exchangers are useful in heat recovery systems, but in some circumstances can require a significant refrigerant charge, because the outlet of the heat recovery exchanger can contain a substantial amount of liquid refrigerant that flows to the condenser. The liquid rate into the condenser increases and, when the inlet of condenser is with high liquid rate, the refrigerant amount in the condenser fills with liquid, and is much higher than when the inlet of the condenser receives refrigerant vapor only.

Using a liquid separator in the heat recovery systems herein to separate the liquid and vapor from the fluid exiting the heat recovery exchanger can ensure that the inlet of the condenser coil is sourced with vapor and minimizes liquid entering the condenser coil, if at all, such as during normal operating modes (e.g. cooling and/or heat recovery modes).

In an embodiment, the liquid separator does not receive liquid refrigerant from the condenser coil, such as in a regular operating mode (e.g. cooling and/or heating mode). The use of the liquid separator and its arrangement within the fluid circuit can thereby reduce the operating refrigerant charge needed for the system.

In an embodiment, liquid flows out of the liquid separator and through a valve, then into another portion of the fluid circuit. For example, the liquid flows out of the liquid separator to a liquid portion of the condenser coil, such as for example a sub-cooling section, while vapor flows out of the liquid separator and into the condenser coil at a vapor inlet to be condensed to liquid by the condenser coil and then flow into the liquid portion. The liquid in other examples can flow to the expansion device and not flow to the condenser, e.g. liquid portion or sub-cooling section.

Heat recovery systems herein can include any suitable fluid system which can recover heat generated and/or rejected by the system to be used for another purpose. Examples include but are not limited to fluid chillers, such as for example water chillers, and also heat pumps, which may include heat recovery and/or hot water supply. In an embodiment, the charge of fluid is one or more refrigerants or a refrigerant mixture, which may include a lubricant such as for example oil, and potentially other additives.

The heat recovery systems herein, by use of the liquid separator, can provide both cooling and heating (e.g. heat recovery) at a relatively large capacity but with relatively lower refrigerant charge requirements. This can result in being able to employ a relatively smaller receiver, as the receiver acts as a liquid separator.

The heat recovery design herein can be useful in the design of for example a fluid chiller, such as for example an air cooled chiller with heat recovery options having less refrigerant charge added and high reliability. Use of the liquid separator reduces and/or avoids liquid from going into the inlet of the condenser coil, requiring less charge.

In an embodiment, a flow control device can control the heat recovery and/or cooling capacity of the heat recovery system.

In an embodiment, a heat recovery system includes a compressor, a heat recovery exchanger in fluid communication with the compressor, a liquid separator in fluid communication with the heat recovery exchanger. The liquid separator includes a vapor outlet and a liquid outlet. The heat recovery system includes a condenser having an inlet in fluid communication with the vapor outlet of the liquid separator. The liquid outlet of the liquid separator is in fluid communication with a component of the system other than the inlet of the condenser, where liquid from the liquid outlet flows downstream of the condenser. The heat recovery system includes an expansion device in fluid communication with the condenser and the component, and an evaporator in fluid communication with the expansion device and the compressor.

In an embodiment, the heat recovery system includes a flow control device between the vapor outlet of the liquid separator and the inlet of the condenser, the flow control device is in fluid communication with the vapor outlet of the liquid separator and in fluid communication with the inlet of the condenser.

In an embodiment, the heat recovery system includes a flow control device between the liquid separator and the component, the flow control device is in fluid communication with the liquid outlet of the liquid separator and in fluid communication with an inlet of the component.

In an embodiment, one or more of the flow control devices herein are one of a solenoid valve, multiple solenoid valves in parallel flow, and a graduating device.

In an embodiment, the heat recovery exchanger is in fluid communication with the condenser during cooling mode and/or heat recover mode only by way of the vapor outlet of the liquid separator.

In an embodiment, the inlet of the condenser is not in fluid communication with a liquid line of the system.

In an embodiment, the condenser includes a condensing section and a sub cooling section. The inlet of the condenser is to the condensing section, and the sub cooling section is the component in fluid communication with the liquid outlet of the liquid separator.

In an embodiment, a method of fluid flow through a fluid circuit during a cooling mode and/or a heat recovery mode includes: compressing a working fluid into a vapor; directing the working fluid from the compressor to a heat recovery exchanger in fluid communication with the compressor; recovering heat from the working fluid passing through the heat recovery exchanger, the working fluid including some liquid as a result of the step of recovering heat; directing the working fluid to a liquid separator in fluid communication with the heat recovery exchanger, the liquid separator including a vapor outlet and a liquid outlet; separating vapor from the liquid of the working fluid; directing the separated vapor into an inlet of a condenser, which is in fluid communication with the vapor outlet of the liquid separator; directing the liquid from the working fluid into an inlet of a component, which is in fluid communication with the liquid outlet of the liquid separator; directing the vapor through the condenser to condense the vapor into liquid, and directing the liquid condensed by the condenser and the liquid from the component to an expansion device to expand the liquid, the expansion device is in fluid communication with the condenser; directing the expanded liquid to an evaporator to evaporate the expanded liquid, the evaporator is in fluid communication with the expansion device; and directing the evaporated fluid back to the compressor.

In an embodiment, the method includes controlling flow to the inlet of the condenser by using a flow control device between the liquid separator and the condenser, the flow control device is in fluid communication with the vapor outlet of the liquid separator and in fluid communication with the inlet of the condenser.

In an embodiment, the method includes controlling flow to the inlet of the component by using a flow control device between the liquid separator and the component, the flow control device is in fluid communication with the liquid outlet of the liquid separator and in fluid communication with the inlet of the component. In embodiment, the flow control device between the liquid separator and the component is to let liquid in the liquid separator flow out and stop vapor flow until for example, there is no liquid in the separator.

In an embodiment, the step of directing the separated vapor into the inlet of the condenser includes fluid communication of the heat recovery exchanger with the condenser only by way of the vapor outlet of the liquid separator.

In an embodiment, the step of directing the separated vapor into the inlet of the condenser includes the inlet of the condenser not being in fluid communication with a liquid line of the fluid circuit.

In an embodiment, the condenser includes a condensing section and a sub-cooling section. The inlet of the condenser is to the condensing section, and the sub-cooling section is the component in fluid communication with the liquid outlet of the liquid separator.

DRAWINGS

These and other features, aspects, and advantages of the heat recovery system and methods of use thereof will become better understood when the following detailed description is read with reference to the accompanying drawing, wherein.

While the above figures set forth embodiments of the heat recovery system and methods of use thereof, other embodiments are also contemplated, as noted in the following descriptions. In all cases, this disclosure presents illustrated embodiments of the heat recovery system and methods of use thereof by way of representation but not limitation. Numerous other modifications and embodiments can be devised by those skilled in the art which fall within the scope and spirit of the principles of the heat recovery system and methods of use thereof described herein.

DETAILED DESCRIPTION

The disclosure herein relates generally to a heat recovery system, such as for example, a refrigerant system that provides cooling and heating. In particular the disclosure herein relates to a heat recovery system that includes a liquid separator, which allows for less refrigerant charge to be needed for operation of the system relative to for example certain and parallel flow systems.

Figure 1:
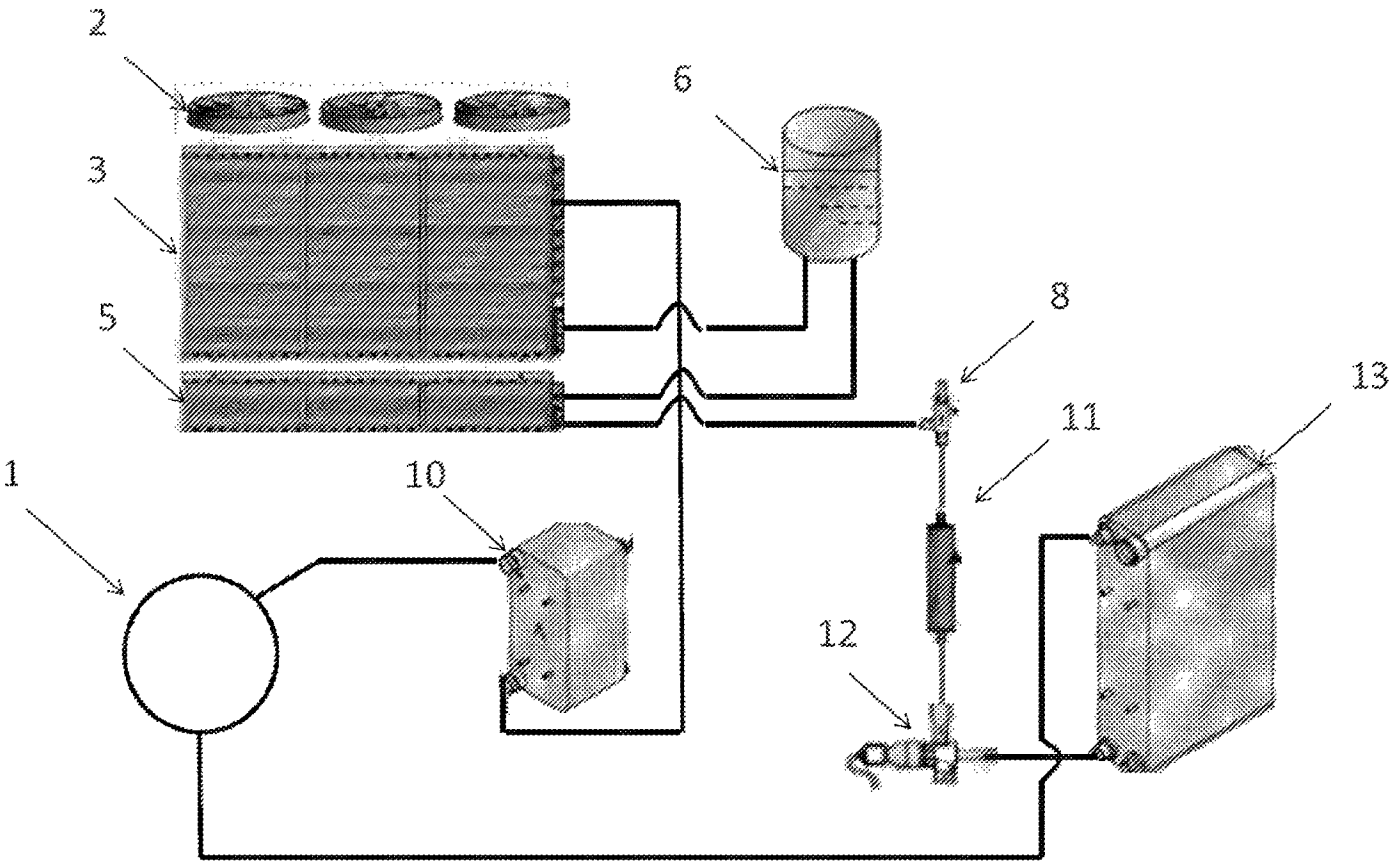
FIG. 1 is a schematic view of a heat recovery system having a fluid circuit using a serial flow operation.

FIG. 1 is a schematic view of a heat recovery system having a fluid circuit using a serial flow operation.

In the example shown, the heat recovery system is an air-cooled chiller with heat recovery capability. The heat recovery exchanger 10 is between the discharge of the compressor 1 and the condenser, e.g. the condensing section of the coil 3. This connection is called a serial design. In FIG. 1, the components include the compressor(s) 1 or one compressor only, heat recovery exchanger 10, condensing section 3 of the coil, fan(s) 2, sub-cooling section 5 of the coil, refrigerant receiver 6, angle valve 8, filter and dryer 11, expansion device 12, and evaporator 13.

The system of FIG. 1 in some circumstances can have limited heat recovery capacity, because the high pressure side condensing temperature depends on heat exchange of the air side in the coil 3, which is mainly related to the air temperature and flow rate. In a serial design, the heat recovery exchanger 10 and the condenser (e.g. air cooled condenser) share the high pressure side heat rejection of the refrigeration cycle condensing. As shown, the heat recovery capacity depends on the capacity of the heat recovery exchanger, compared with the capacity of the condenser.

Furthermore, serial connection designs need significantly more refrigerant charge. A reason is that refrigerant entering the condenser coil 3 is two phase (vapor and liquid) instead of superheated refrigerant vapor, since the refrigerant first passes through the heat recovery exchanger 10 and condenses before entering the condenser coil 3. This can result in more liquid charge in the condenser coil 3 and relative piping. Such a system may also employ additional devices to regulate water flow, and to limit heat exchange capacity, such as when a water temperature through the heat recovery exchanger is too low.

While the serial design of FIG. 1 can in some circumstances provide a simple and reliable circuit structure, as there is no control, a relatively large receiver 6 may be required to handle the significantly large refrigerant charge that can fill the condenser coil 3. For example the system of FIG. 1 can employ about 25 Kg of refrigerant to provide a suitable capacity for both cooling by the condensing coil 3 and heat recovery by the heat recovery exchanger 10.

Figure 2:
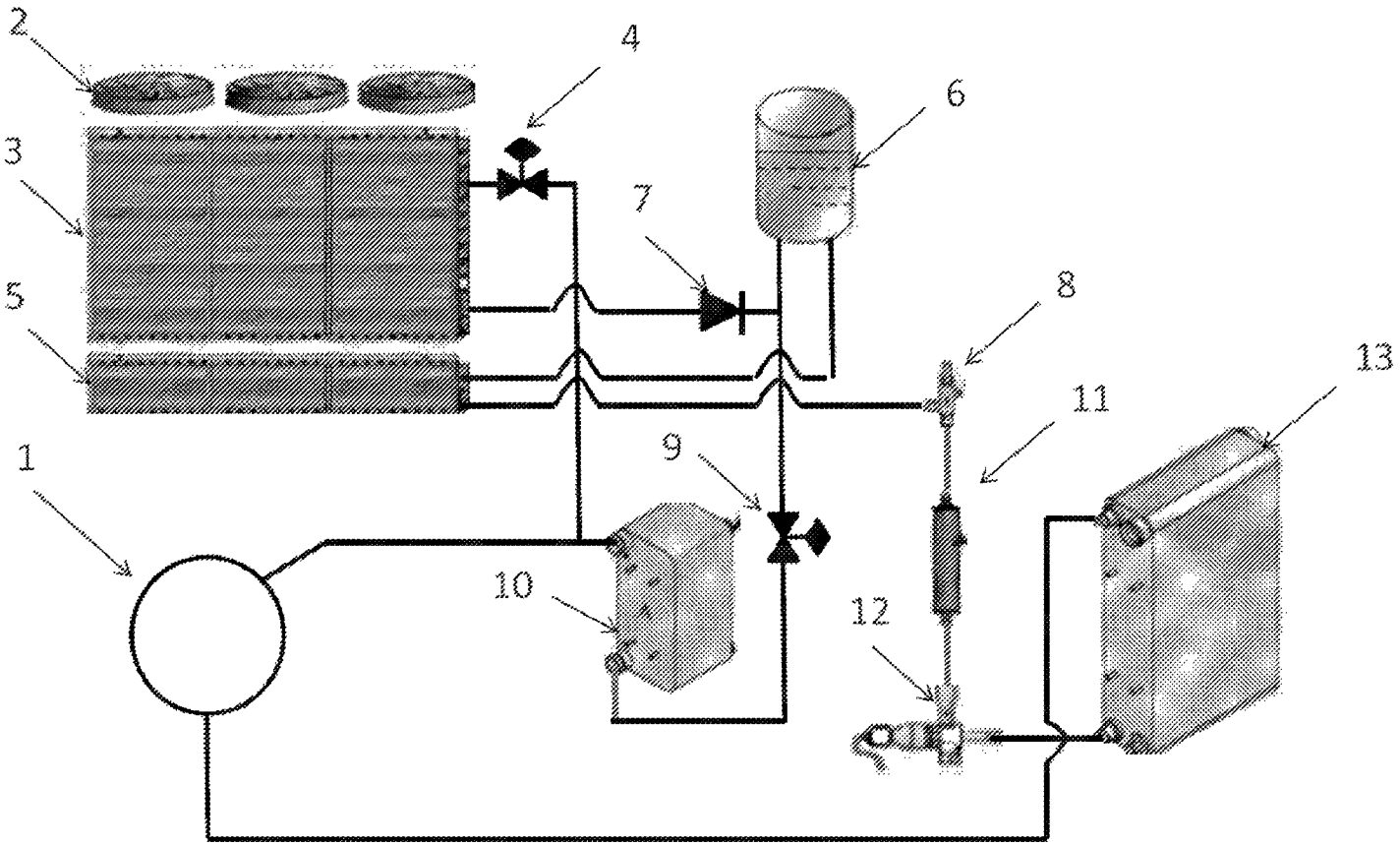
FIG. 2 is a schematic view of a heat recovery system having a fluid circuit using a parallel flow operation.

FIG. 2 is a schematic view of a heat recovery system having a fluid circuit using a parallel flow operation.

In FIG. 2, the example is also an air-cooled with heat recovery capability. In a parallel flow connection the heat recovery exchanger 10 is paralleled with the condensing coil 3. In FIG. 2, the components include one or more compressors 1, fan(s) 2, condensing coil 3, solenoid valve 4, sub-cooler section 5, refrigerant receiver 6, check valve 7, angle valve 8, solenoid valve 9, heat recovery exchanger 10, filter and dryer 11 expansion valve 12, and evaporator 13. When cooling at low ambient temperature, for example, the system employs a significant amount of refrigerant to maintain stability and the heat recovery capacity may also be relatively low. Thus, in a normal heat recovery design, a large receiver is used to balance the refrigerant quantity difference at different conditions. This may occur for example at relatively low ambient temperature when the refrigerant entering the condenser coil 3 becomes liquid very quickly. The heat recovery capacity may be relatively large compared to a serial design, and may use relatively less refrigerant than a serial design, such as for example in some circumstances about 15-16 Kg. However, in a parallel design, the fluid circuit is either for heat recovery (e.g. valve 9 is open and valve 4 is closed) or for cooling (valve 9 is closed and valve 4 is open), and it may not be common to simultaneously run the cooling and heating functions.

In both of the serial design (FIG. 1) and the parallel design (FIG. 2), neither receiver 6 provides liquid/vapor separation capability.

Figure 3:
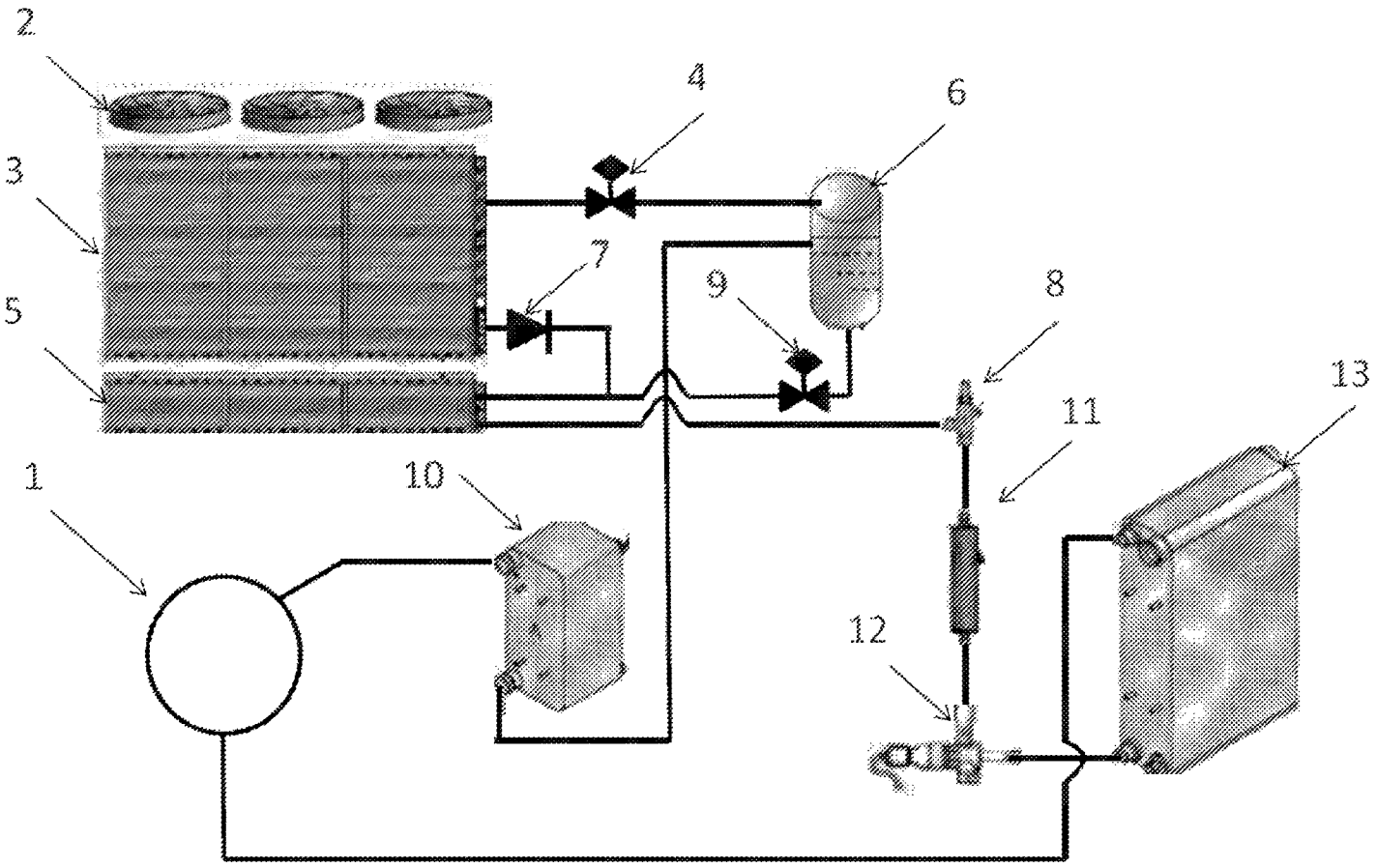
FIG. 3 is a schematic view an embodiment of a heat recovery system having a fluid circuit using a liquid separator on a vapor inlet line to a condenser.

FIG. 3 is a schematic view an embodiment of a heat recovery system having a fluid circuit using a liquid separator on a vapor inlet line to a vapor inlet of the condenser.

The design of FIG. 3 can improve the heat recovery capacity, reduce the refrigerant charge, and maintain operating stability.

FIG. 3 shows the improved heat recovery fluid circuit, which is to include the advantages of both serial type and parallel type, e.g. simultaneous cooling and heat recovery (e.g. FIG. 1) with good capacity (e.g. FIG. 2), but with further improvement of requiring relatively less refrigerant charge. In some embodiments, the refrigerant charge needed is less than a parallel flow and may be as low as 10 Kg or about 10 Kg. In FIG. 3, the components include one or more compressors 1, heat recovery exchanger 10, liquid separator 6, a flow control device, e.g. solenoid valve or solenoid valves parallel 4, fan(s) 2, condensing section of the coil 3, check valve 7, sub-cooler 5, valve to control liquid level in the separator 9, angle valve 8, filter and dryer 11, expansion device 12, evaporator 13. It will be appreciated that the pressure in the liquid separator 6 is higher than the outlet of the check valve 7, and so liquid flow does not go back to the liquid separator 6 from the condenser 3.

It will be appreciated that the liquid outlet of the liquid separator is in fluid communication with a component of the system other than the inlet of the condenser. In an embodiment, the heat recovery system does not include a sub-cooling section 5. In FIG. 3, it will be appreciated that the sub-cooling 5 can be removed from the system. If there is not sub-cooling section 5, the liquid in liquid separator 6 may flow through valve 9 and directly into angle valve 8 or to another line in fluid communication with the expansion device.

In an embodiment, the condenser 3 includes a condensing section in fluid communication with a sub cooling section. The inlet of the condenser is to the condensing section, and the sub cooling section is the component in fluid communication with the liquid outlet of the liquid separator. This configuration is shown in FIG. 3.

As shown in FIG. 3, the condensing section includes an inlet in fluid communication with the vapor outlet of the liquid separator, and the sub-cooling section includes an inlet in fluid communication with the liquid outlet of the liquid separator. The heat recovery system includes an expansion device in fluid communication with the sub-cooling section of the condenser, and an evaporator in fluid communication with the expansion device and the compressor.

In some designs, pressure regulating valve or valves 7 provide such functions. For example, the valve 7 is a check, which ensures refrigerant flow out of the condenser 3. It will be appreciated that the valve 7 may be changed to a regulating valve with variable flow, so that the flow rate through the condenser 3 can be changed, and so as to change the heat transfer through the condenser 3. The less flow through the condenser, then the more flow through valve 9, which can in some circumstances result in more refrigerant condensing in the heat recovery exchanger 10 providing more heat recovery. It will be appreciated that a regulating valve may be used as the flow control device 4. Its function is the same as using a regulating valve as the valve 7. The differences potentially are size and cost.

With such a design as in FIG. 3, the system can use a relatively smaller vessel than the receivers in FIGS. 1 and 2, where the receiver 6 of FIG. 3 in contrast provides vapor/liquid separation. This can provide the environmental benefit if using relatively smaller amounts of refrigerant charge, because the inlet of the heat recovery exchanger 10 is vapor only and the condenser coil 3 will not contain as much refrigerant, since it receives vapor from the vapor outlet of the separator 6.

By adjusting pressure regulating valve and fan speed, different heat recovery capacity can be obtained. And the manufacturing cost may be close to a-serial type designs. It will be appreciated that the flow control device or valve 4 can be removed when there may be cost limitations, and where there may not be a need for high capacity heat recovery or where the ambient temperature is always high.

In an embodiment, of the control items 1 and 2 provide further explanation.

1. When there is cooling only, the flow control device 4, e.g. solenoid valve, is open. Refrigerant is discharged from compressor 1, to heat recovery exchanger 10, then to liquid separator 6, and then to the condensing section of the coil 3, then into the sub cooling section 5 of the coil, and then passing to the expansion device (e.g. valve), then into the evaporator 13 for cooling. Flow control device 9, e.g. solenoid valve, can be open to reduce the risk of oil logging in the liquid separator 6.

In an embodiment, it will be appreciated that the flow control device can also be one valve controlled by a liquid level in the liquid separator 6.

In an embodiment, the flow control device can be floating valve and built in the receiver.

2. If the flow control device 4 includes multiple valves, e.g. solenoid valves, that are paralleled, then different valve (s) can be opened to obtain get different heat recovery capacity. In an embodiment, the flow control device can be a controllable and/or graduated device that is not structured as multiple valves but provides capacity management. Some refrigerant passes heat recovery exchanger 10, and different levels of heating capacity, including relatively lower levels of heating capacity may be obtained. Fans 2 are adjusted by differential pressure.

Aspects: Any of aspects 1 to 8 may be combined with any of aspects 9 to 14.

Aspect 1. A heat recovery system, comprising:

a compressor;

a heat recovery exchanger in fluid communication with the compressor;

a liquid separator in fluid communication with the heat recovery exchanger, the liquid separator including a vapor outlet and a liquid outlet;

a condenser having an inlet in fluid communication the vapor outlet of the liquid separator, the liquid outlet of the liquid separator is in fluid communication with a component of the system other than the inlet of the condenser, where liquid from the liquid outlet flows downstream of the condenser;

an expansion device in fluid communication with the condenser and the component; and an evaporator in fluid communication with the expansion device and the compressor.

Aspect 2. The heat recovery system of Aspect 1, further comprising a flow control device between the vapor outlet of the liquid separator and the inlet of the condenser, the flow control device is in fluid communication with the vapor outlet of the liquid separator and in fluid communication with the inlet of the condenser.

Aspect 3. The heat recovery system of Aspect 2, wherein the flow control device between the liquid separator and the condenser is one of a solenoid valve, multiple solenoid valves in parallel flow, and a graduating device.

Aspect 4. The heat recovery system of any one of Aspects 1 to 3, further comprising a flow control device between the liquid separator and the component, the flow control device is in fluid communication with the liquid outlet of the liquid separator and in fluid communication with an inlet of the component.

Aspect 5. The heat recovery system of Aspect 4, wherein the flow control device between the liquid separator and the component is one of a solenoid valve, multiple solenoid valves in parallel flow, and a graduating device.

Aspect 6. The heat recovery system of any one of Aspects 1 to 5, wherein the heat recovery exchanger is in fluid communication with the inlet of the condenser only by way of the vapor outlet of the liquid separator.

Aspect 7. The heat recovery system of any one of Aspects 1 to 6, wherein the inlet of the condenser is not in fluid communication with a liquid line of the system.

Aspect 8. The heat recovery system of any one of Aspects 1 to 7, wherein the condenser includes a condensing section and a sub cooling section, the inlet of the condenser is to the condensing section, and the sub-cooling section is the component in fluid communication with the liquid outlet of the liquid separator.

Aspect 9. A method of fluid flow through a fluid circuit during both a cooling mode and a heat recovery mode, comprising:

compressing a working fluid into a vapor;

directing the working fluid from the compressor to a heat recovery exchanger in fluid communication with the compressor;

recovering heat from the working fluid passing through the heat recovery exchanger, the working fluid including some liquid as a result of the step of recovering heat;

directing the working fluid to a liquid separator in fluid communication with the heat recovery exchanger, the liquid separator including a vapor outlet and a liquid outlet;

separating vapor from the liquid of the working fluid;

directing the separated vapor into an inlet of a condenser, which is in fluid communication with the vapor outlet of the liquid separator;

directing the liquid from the working fluid into an inlet of a component, which is in fluid communication with the liquid outlet of the liquid separator;

directing the vapor through the condenser to condense the vapor into liquid, and directing the liquid condensed by the condenser and the liquid from the component to an expansion device to expand the liquid, the expansion device is in fluid communication with the condenser;

directing the expanded liquid to an evaporator to evaporate the expanded liquid, the evaporator is in fluid communication with the expansion device; and directing the evaporated fluid back to the compressor.

Aspect 10. The method of Aspect 9, further comprising controlling flow to the inlet of the condenser by using a flow control device between the liquid separator and the condenser, the flow control device is in fluid communication with the vapor outlet of the liquid separator and in fluid communication with the inlet of the condenser.

Aspect 11. The method of Aspect 9 or 10, further comprising controlling flow to the inlet of the component by using a flow control device between the liquid separator and the component, the flow control device is in fluid communication with the liquid outlet of the liquid separator and in fluid communication with the inlet of the component.

Aspect 12. The method of any one of Aspects 9 to 11, wherein the step of directing the separated vapor into the inlet of the condenser includes fluid communication of the heat recovery exchanger with the condenser only by way of the vapor outlet of the liquid separator.

Aspect 13. The method of any one of Aspects 9 to 12, wherein the step of directing the separated vapor into the inlet of the condenser includes the inlet of the condenser not being in fluid communication with a liquid line of the fluid circuit.

Aspect 14. The method of any one of Aspects 9 to 13, wherein the condenser includes a condensing section and a sub-cooling section, the inlet of the condenser is to the condensing section, and the sub-cooling section is the component in fluid communication with the liquid outlet of the liquid separator.

The terminology used in this specification is intended to describe particular embodiments and is not intended to be limiting. The terms "a," "an," and "the" include the plural forms as well, unless clearly indicated otherwise.

While the embodiments have been described in terms of various specific embodiments, those skilled in the art will recognize that the embodiments can be practiced with modification within the spirit and scope of the claims.

The invention claimed is:

1. A heat recovery system, comprising:

a compressor;

a heat recovery exchanger in fluid communication with the compressor;

a liquid separator in fluid communication with the heat recovery exchanger, the liquid separator including a vapor outlet and a liquid outlet;

a condenser including a condensing section and a sub-cooling section, the condenser having an inlet in fluid communication with the vapor outlet of the liquid separator, the inlet of the condenser is to the condensing section, the liquid outlet of the liquid separator is in fluid communication with the sub-cooling section, where liquid from the liquid outlet flows downstream of the condenser;

an expansion device in fluid communication with the condenser and the sub-cooling section; and an evaporator in fluid communication with the expansion device and the compressor.

2. The heat recovery system of claim 1, further comprising a flow control device between the vapor outlet of the liquid separator and the inlet of the condenser, the flow control device is in fluid communication with the vapor outlet of the liquid separator and in fluid communication with the inlet of the condenser.

3. The heat recovery system of claim 2, wherein the flow control device between the liquid separator and the condenser is one of a solenoid valve, multiple solenoid valves in parallel flow, or a graduated device.

4. The heat recovery system of claim 1, further comprising a flow control device between the liquid separator and the sub-cooling section, the flow control device is in fluid communication with the liquid outlet of the liquid separator and in fluid communication with an inlet of the sub-cooling section.

5. The heat recovery system of claim 4, wherein the flow control device between the liquid separator and the sub-cooling section is one of a solenoid valve, multiple solenoid valves in parallel flow, or a graduated device.

6. The heat recovery system of claim 1, wherein the heat recovery exchanger is in fluid communication with the inlet of the condenser only by way of the vapor outlet of the liquid separator.

7. The heat recovery system of claim 1, wherein the inlet of the condenser is not in fluid communication with a liquid line of the heat recovery system.

8. A method of fluid flow through a fluid circuit during both a cooling mode and a heat recovery mode, comprising:

compressing a working fluid into a vapor;

directing the working fluid from the compressor to a heat recovery exchanger in fluid communication with the compressor;

recovering heat from the working fluid passing through the heat recovery exchanger, the working fluid including some liquid as a result of the step of recovering heat;

directing the working fluid to a liquid separator in fluid communication with the heat recovery exchanger, the liquid separator including a vapor outlet and a liquid outlet;

separating vapor from the liquid of the working fluid;

directing the separated vapor into an inlet of a condenser, which is in fluid communication with the vapor outlet of the liquid separator, the condenser includes a condensing section and a sub-cooling section, the inlet of the condenser is to the condensing section;

directing the liquid from the working fluid into an inlet of the sub-cooling section, which is in fluid communication with the liquid outlet of the liquid separator;

directing the vapor through the condenser to condense the vapor into liquid, and directing the liquid condensed by the condenser and the liquid from the sub-cooling section to an expansion device to expand the liquid, the expansion device is in fluid communication with the condenser;

directing the expanded liquid to an evaporator to evaporate the expanded liquid, the evaporator is in fluid communication with the expansion device; and directing the evaporated fluid back to the compressor.

9. The method of claim 8, further comprising controlling flow to the inlet of the condenser by using a flow control device between the liquid separator and the condenser, the flow control device is in fluid communication with the vapor outlet of the liquid separator and in fluid communication with the inlet of the condenser.

10. The method of claim 8, further comprising controlling flow to the inlet of the sub-cooling section by using a flow control device between the liquid separator and the sub-cooling section, the flow control device is in fluid communication with the liquid outlet of the liquid separator and in fluid communication with the inlet of the sub-cooling section.

11. The method of claim 8, wherein the step of directing the separated vapor into the inlet of the condenser includes fluid communication of the heat recovery exchanger with the condenser only by way of the vapor outlet of the liquid separator.

12. The method of claim 8, wherein the step of directing the separated vapor into the inlet of the condenser includes the inlet of the condenser not being in fluid communication with a liquid line of the fluid circuit.

13. The heat recovery system of claim 4, further comprising a second flow control device between the flow control device and the condenser, the second flow control device is in fluid communication with the condenser and the sub-cooling section.

* * * * *